United States Patent [19]

Fifield et al.

[11] Patent Number: 5,070,671

[45] Date of Patent: Dec. 10, 1991

[54] ROOF TILES

[75] Inventors: John A. Fifield; Leslie G. Hammond, both of Buckinghamshire, Great Britain

[73] Assignee: Oldcastle, Inc., Los Angeles, Calif.

[21] Appl. No.: 536,591

[22] PCT Filed: Jan. 17, 1989

[86] PCT No.: PCT/GB89/00044

§ 371 Date: Jun. 28, 1990

§ 102(e) Date: Jun. 28, 1990

[87] PCT Pub. No.: WO89/06728

PCT Pub. Date: Jul. 27, 1989

[30] Foreign Application Priority Data

Jan. 18, 1988 [GB] United Kingdom ..... 8801006
Nov. 11, 1988 [GB] United Kingdom ..... 8826472

[51] Int. Cl.[5] ..... E04D 1/16

[52] U.S. Cl. ..... 52/533; 52/536; 52/542; 52/560

[58] Field of Search ..... 52/533, 536, 542, 560

[56] References Cited

U.S. PATENT DOCUMENTS

| | | | |
|---|---|---|---|
| 479,442 | 7/1892 | Marvick | 52/533 |
| 2,510,416 | 6/1950 | Pretty | 52/533 |
| 2,624,298 | 1/1953 | Farren | 52/533 |
| 3,440,777 | 4/1969 | Martin | 52/560 |
| 4,731,969 | 3/1988 | Baker et al. | 52/536 |

FOREIGN PATENT DOCUMENTS

| | | |
|---|---|---|
| 0095420 | 5/1983 | European Pat. Off. . |
| 0175500 | 8/1985 | European Pat. Off. . |
| 0093888 | 12/1896 | Fed. Rep. of Germany . |
| 1259641 | 3/1961 | France . |
| 0416649 | 10/1934 | United Kingdom . |
| 2046808 | 11/1980 | United Kingdom . |
| 2178773 | 11/1988 | United Kingdom . |

*Primary Examiner*—Richard E. Chilcot, Jr.
*Assistant Examiner*—Joanne C. Downs
*Attorney, Agent, or Firm*—Panitch Schwarze Jacobs & Nadel

[57] ABSTRACT

An interlocking roof tile (1) of which the leading end portion (12) at least as far as the lower end of, and including the underlock (6) is tapered in the direction of the leading edge (5) of the tile (1).

4 Claims, 7 Drawing Sheets

ROOF TILES

The present invention relates to roof tiles and more particularly but not exclusively to roof tiles made of a cementitious mixture such as concrete or other material such as clay which are laid in a straight relationship or a staggered relationship, e.g. so called slate and plain tiles.

Roof tiles can be made from a cementitious mixture including sand and/or other aggregate, cement, colouring pigment and water plus optionally one or more other additives to facilitate extrusion, prevent growth of fungus, etc. Such tiles have been produced by extrusion for over forty years with apparatus including a hopper-like box which is disposed above a conveyor path and which is charged with the cementitious mixture. The flow of the cementitious mixture is assisted in the box by means of a rotating paddle disposed therewithin. A succession of pallets for moulding the undersurface of the tiles is driven along the conveyor path and beneath the box so that the cementitious mixture forms on the pallets and is compressed therein by means of a rotating roller disposed within the box downstream of the paddle and having a contour which corresponds to the upper surface of the tiles to be formed.

The cementitious mixture is further compressed on the pallets as they pass out of the box by means of a slipper which is disposed downstream of the roller and also has a contour which corresponds to that of the upper surface of the tile to form a continuous extruded ribbon of cementitious mixture on the pallets. The ribbon is subsequently cut into tile forming lengths downstream of the box by means of a suitable cutting knife and the pallets with the formed tiles thereon are conveyed to a curing location. At the curing location, the tiles are conveyed through a curing chamber which is maintained at a high relative humidity and temperature. The curing time is usually in excess of 6 hours. The tiles undergo only a partial curing in the curing chamber from whence they are conveyed to, and stacked, out-of-doors, to complete the curing process.

Natural slate and concrete plain tiles are, as is known, laid on the roof in a staggered relationship and double lapped, i.e. so that there is always a tile underneath the abutting side edges of adjacent tiles to guard against rain and wind driven water entering into the roof space between the abutting side edges. Traditionally, natural slates have a generally flat geometry with a substantially constant thickness of approximately 10 mm and have a laid weight of approximately 20–40 Kg/m$^2$. On the other hand, conventional concrete plain tiles have a cambered geometry, a substantially constant thickness of approximately 12 mm and a laid weight of 75 kg/m$^2$. With both natural slate and concrete plain tiles the leading edge (i.e. the lower edge) thickness when the tiles are laid provides an aesthetically pleasing appearance. However, it has long been an object to avoid the necessity to double lap the tiles to reduce the number of laid tiles per roof and therefore the cost but still retain the aesthetic appearence produced by laying the tile in a staggered relationship, and a visible lower edge similar to existing clay and concrete plain tiles, and natural slates, in particular in the case of retiling old roofs. Applicants have manufactured interlocking extruded concrete slate tiles which avoid the necessity for double lapping and which have the generally flat geometry of a natural slate and a substantially constant edge thickness. However, the lower edge thickness is 25 mm and is necessary in order to provide sufficient strength to avoid breaking off, and to accommodate the interlocks, i.e. the overlocks and underlocks extending along opposite side edges respectively of each tile. Whilst such concrete slate tiles are designed to be laid in a staggered relationship they are not specified in preference to natural slate and conventional plain tiles because the aesthetic appearance is wrong, i.e. the leading edge thickness is twice that of the optimum required thickness. Furthermore, although the undersurfaces of the tiles have been hollowed out to reduce the weight, the laid weight of these known concrete/interlocking slates is still 52 kg/m$^2$ which is considerably more than that of natural slates so that the replacement of natural slates by concrete slates in retiling would require the additional expense of strengthening or replacing the roof timbers.

Even if these known concrete slates were made of material which reduced the weight of tiles, such a step would decrease the leading edge thickness only down to 18 mm which is still too thick to compete against natural slates and conventional plain tiles.

Accordingly the main object of the present invention is to provide an interlocking roof tile which can be laid in a staggered relationship and in which the aforesaid disadvantages are minimized or avoided.

To this end, the present invention consists in an interlocking roof tile, of which the lower end portion including the underlock, at least as far as the lower end of the underlock, is tapered in the direction of the lower edge of the tile.

By means of the invention the lower edge thickness may be substantially reduced, i.e. to as little as approximately 10 mm, which is less than that of conventional plain tiles and compares favourably with the body thickness of natural slates. Without changing either the geometry of the pallets or the tile extrusion head, in the case of extruded tiles, a concrete slate tile can be transformed into a plain tile or rather a double-plain tile by a simple operation performed either on the upper surface of the extruded cementitious material ribbon or tile forming lengths, severed from the ribbon.

Thus, the invention provides interlocking roof tiles which have the appearance and perceived thickness of plain tiles or similar thickness to natural slate and which are capable of being laid either in a straight relationship or a staggered relationship and of being made to a laid weight of, say, approximately 20 to 40 kg/m$^2$, and preferably of approximately 20 to 28 kg/m$^2$, thereby to form a completely satisfactory replacement for natural slate roofing.

Tiles made in accordance with the invention may be of flat or of cambered geometry, whichever is preferred or desirable. For example, to produce a look-alike concrete slate, a tile of flat geometry is acceptable and may be even be preferred.

In some instances it may be aesthetically desirable for the underlock not to be visible when laid, to which end the underlock may end short of the lower edge of the tile.

With such a construction it is possible to have the undersurface of the lower edge portion of the tile beyond the lower end of the underlock disposed generally parallel to the opposed upper surface of the tile, which reduces the amount of material required to make the tile and therefore its weight.

Conveniently, therefore, there is a step between the lower end of the underlock and the undersurface of the adjacent lower edge portion of the tile beyond the underlock.

Applicant has made such tiles with a reduction in the thickness of the lower edge of approximately 6 mm.

Preferably the underlocks for such tiles will be typically approx. 8 mm thick at the thickest point reducing to approx 4 mm thick at the overlapping portion.

Furthermore, by means of the tapered lower end portion of the tile, the tile undersurface in the lower edge region can abut closely against the upper surface of the next adjacent lower line of the tiles.

The scale of the thining to produce the tapered lower end portion of the tile advantageously enables there to be an overlap with each next adjacent lowest line of tiles of typically 75 mm approx. and the tile to have, conveniently, with tiles of cambered geometry, a camber of approx. 1600–1800 mm. radius of curvature. Advantageously, the tile is made of any of the cementitous mixtures or materials described in the specification of our PCT/GB88/00691 application (copending U.S. patent application Ser. No. 348,639, filed Aug. 22, 1988), the subject matter of which is incorporated into the specification of this application by reference.

More particularly, the tile of the present invention is made from a cementitious mixture comprising a porous lightweight aggregate capable of retaining water, an hydraulic cement, water, an agent for enhancing flexural strength and an agent for enhancing the water retention capacity of the porous lightweight aggregate during curing of the cementitious mixture, with the porous lightweight aggregate, hydraulic cement, water, flexural strength enhancing agent and water retention enhancing agent being present in proportions which provide the interlocking roof tile with improved impact and flexural strengths.

In order to provide a plain tile instead of a concrete slate, the upper surface of the extruded ribbon or tile forming lengths are provided with a continuous or non-continuous groove, e.g. by means of a knife or wheel, which extends from the upper edge or end to the lower end or edge of the tile. Thus, there is, in effect, produced a one piece tile which has the appearance of two plain tiles. It should be understood that, in this specification reference to a plain tile includes such a tile having the appearance of two or more plain tiles.

In order that the invention may be more readily understood, some embodiments thereof will now be described, by way of example, with reference to the accompanying drawings, in which.

Figure 1:
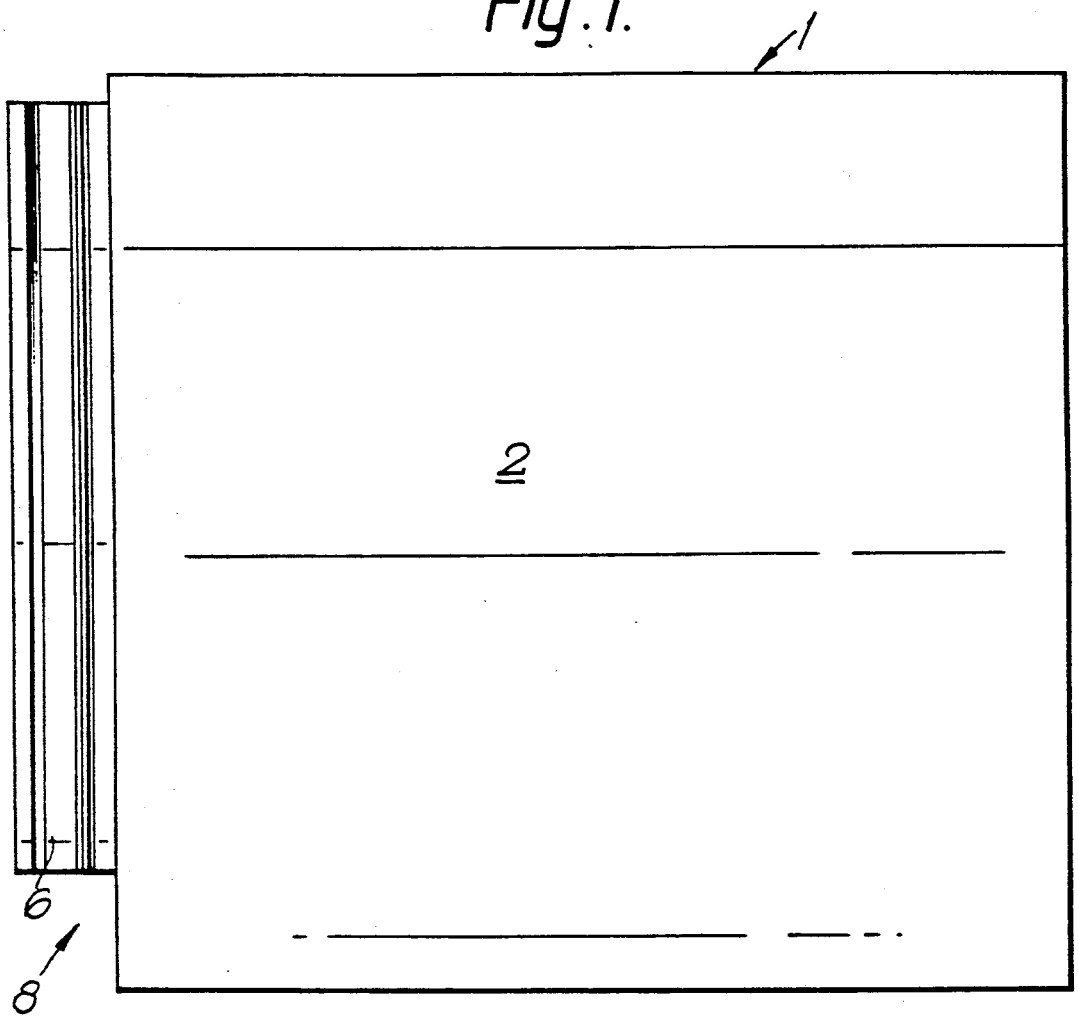
FIG. 1 is a top plan view of one embodiment of concrete roof tile made in accordance with the invention and in the form of an interlocking concrete slate.
Figure 2:
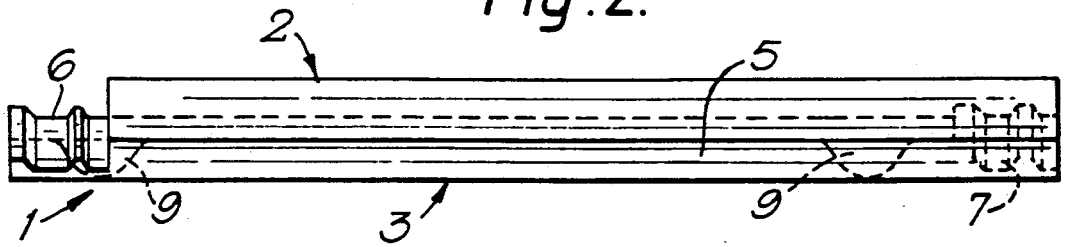
FIGS. 2 and 3 are upper and lower end or edge views respectively of the slates of FIG. 1.
Figure 3:
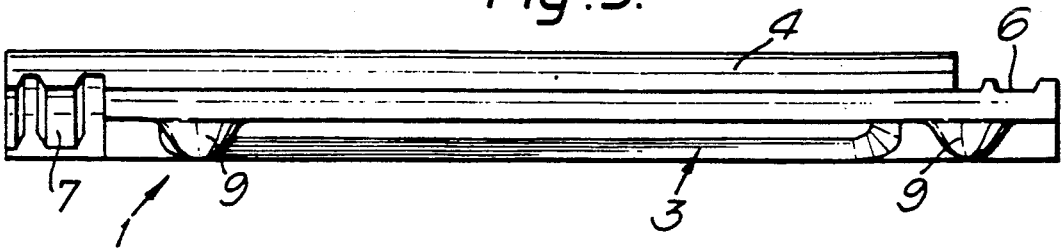
Figure 4:
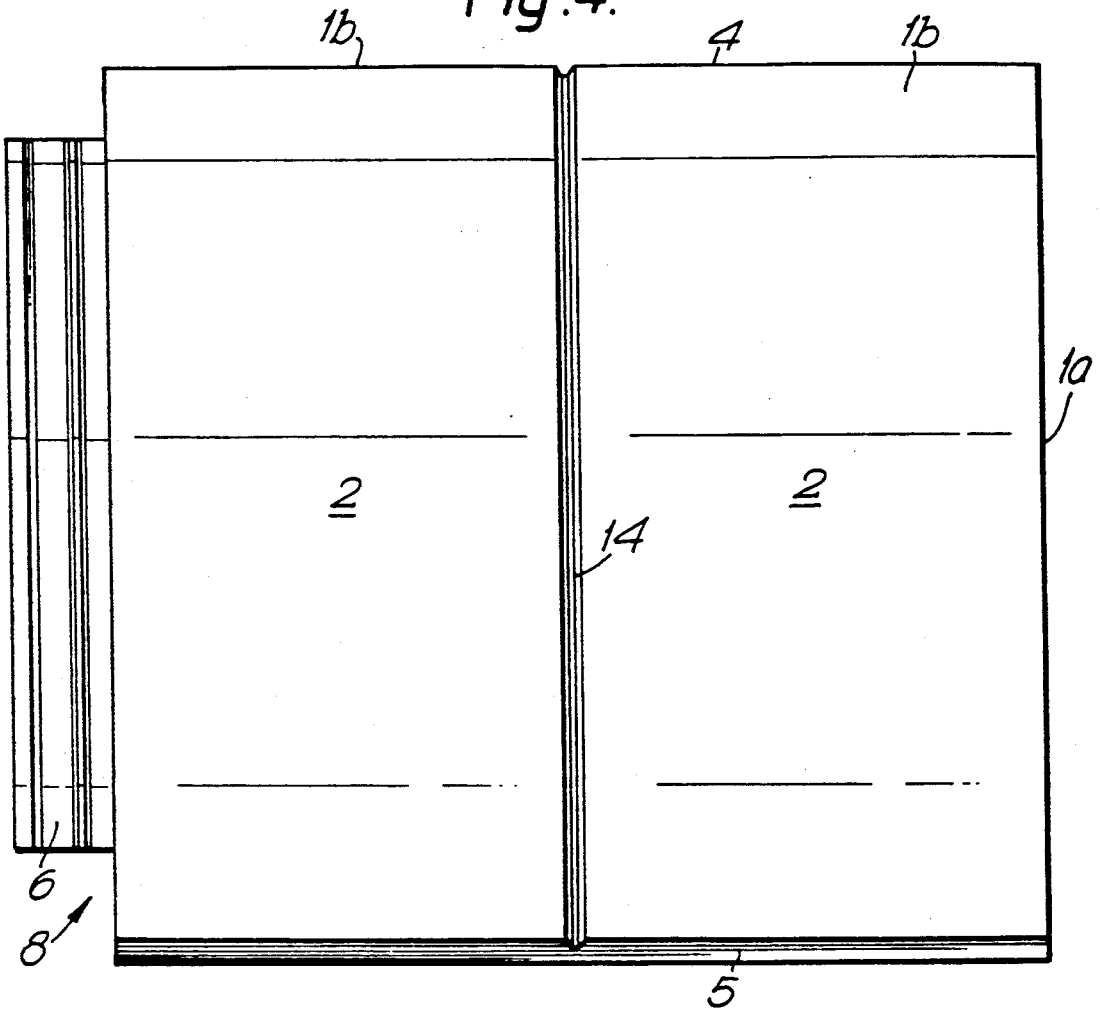
FIG. 4 is a top plan view of another embodiment in the form of a concrete interlocking double plain tile.
Figure 7:
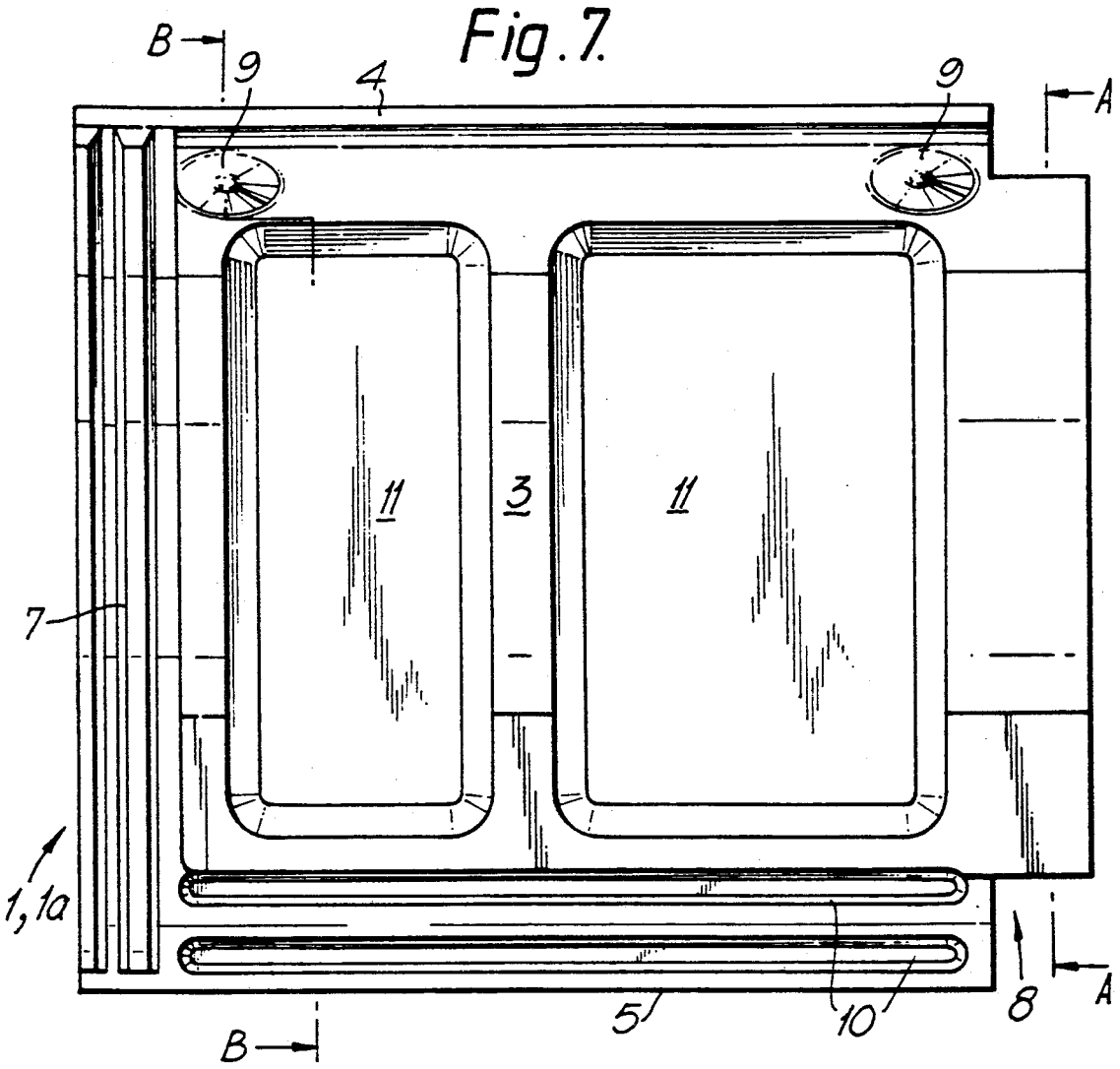
Figure 8:
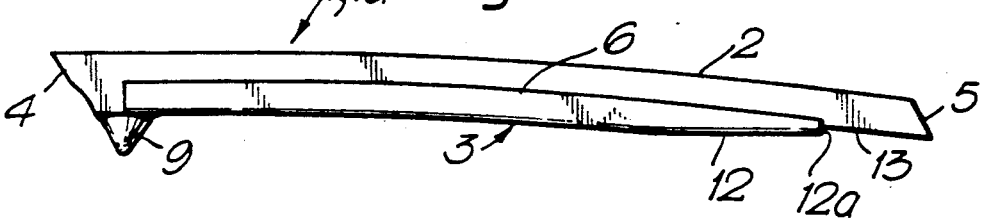
Figure 9:
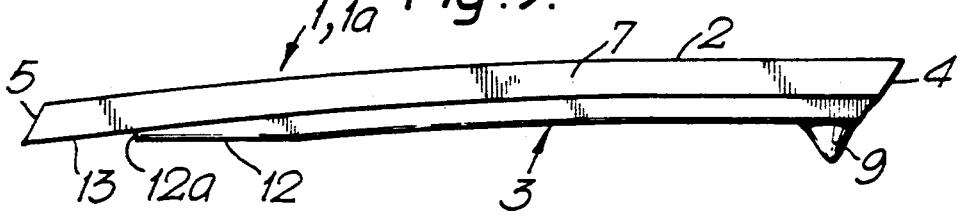
Figure 10:
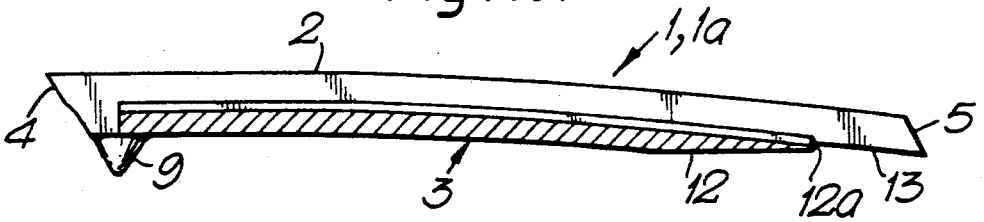
Figure 11:
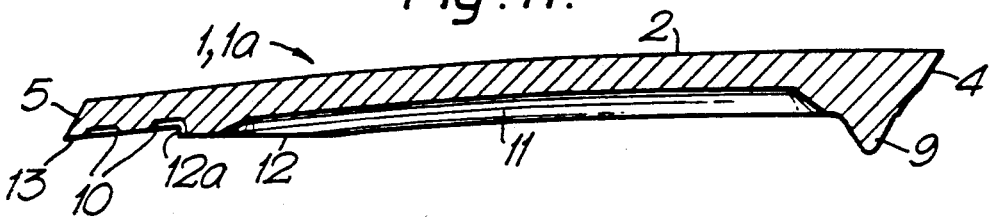
Figure 15:
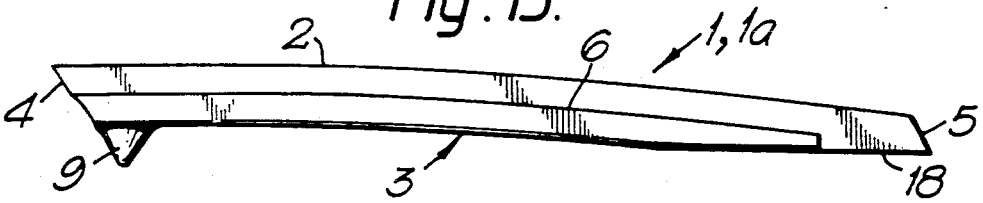
Figure 16:
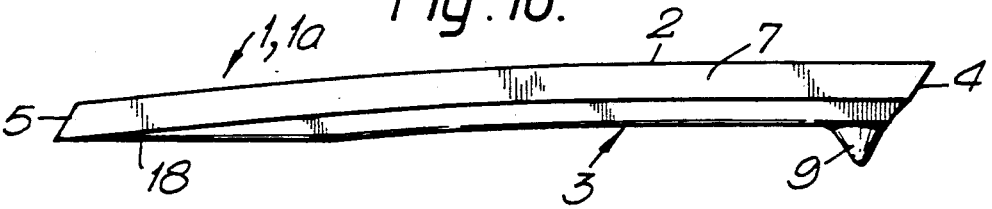
Figure 17:
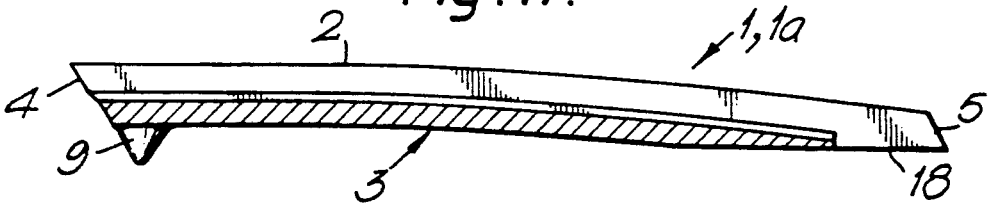
Figure 18:
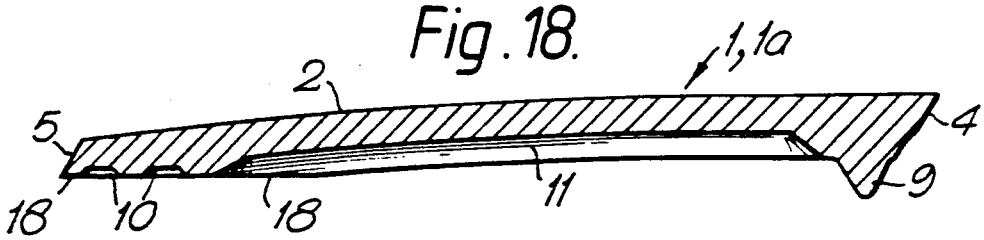
Figure 12:
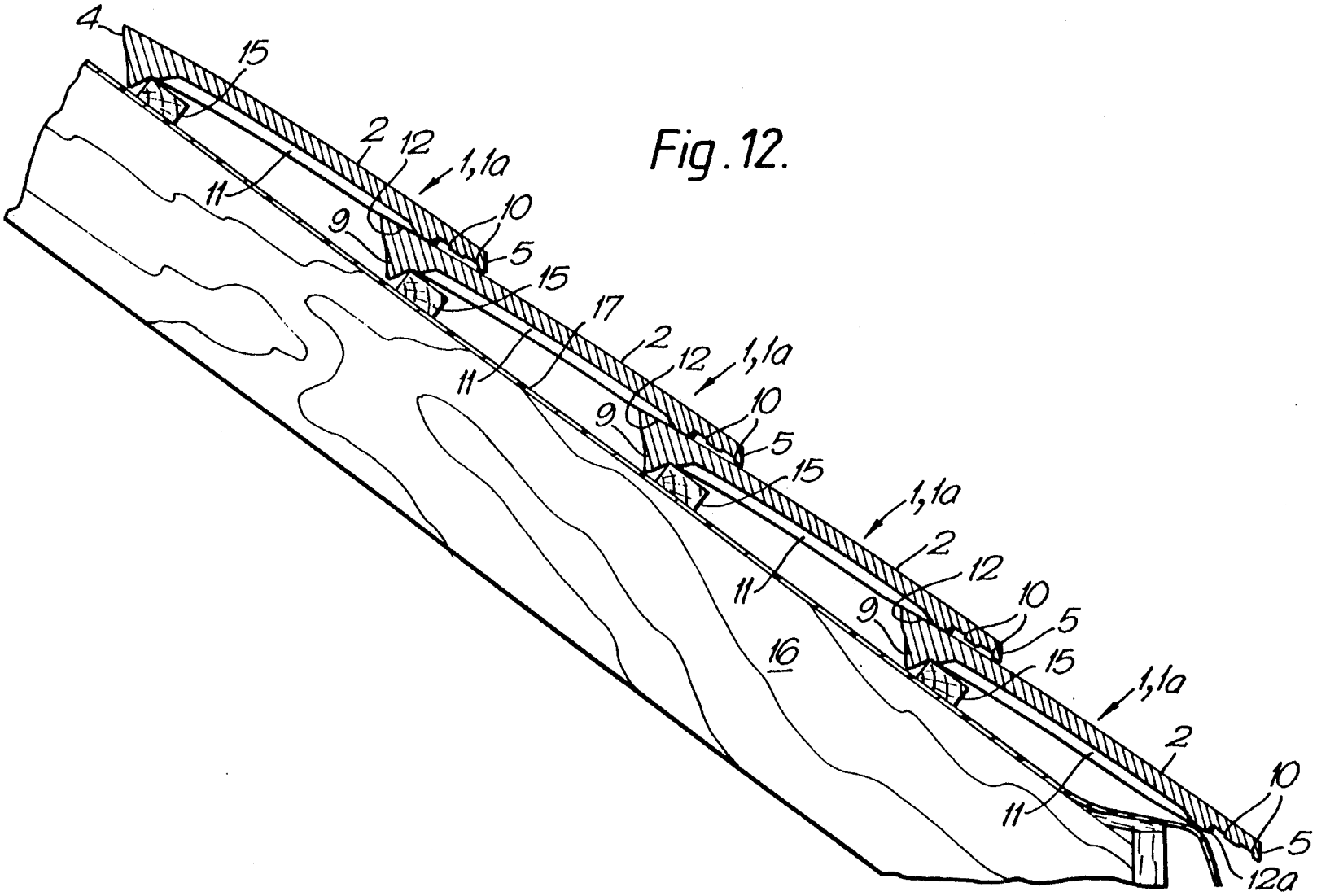
Figure 13:
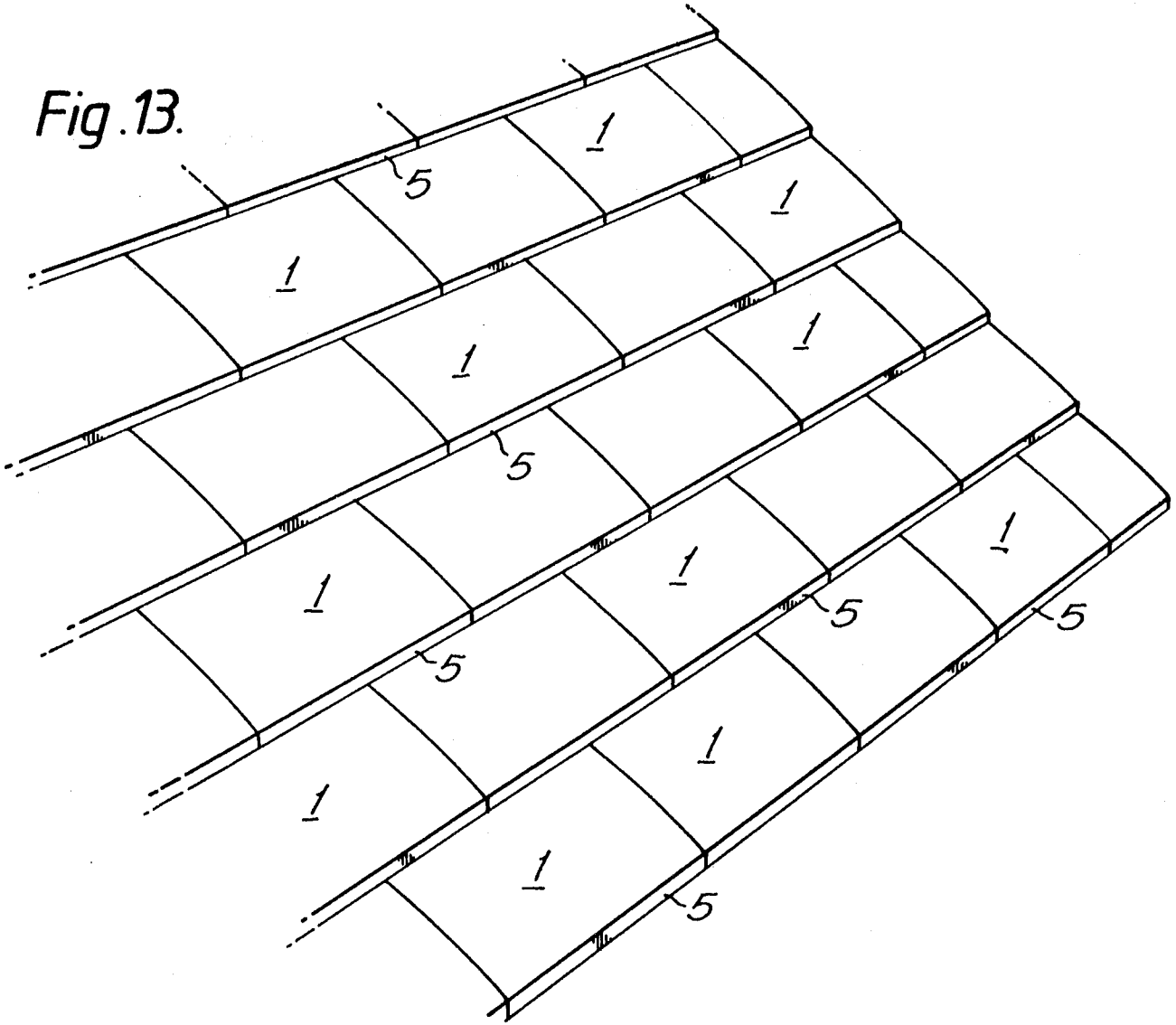
Figure 14:
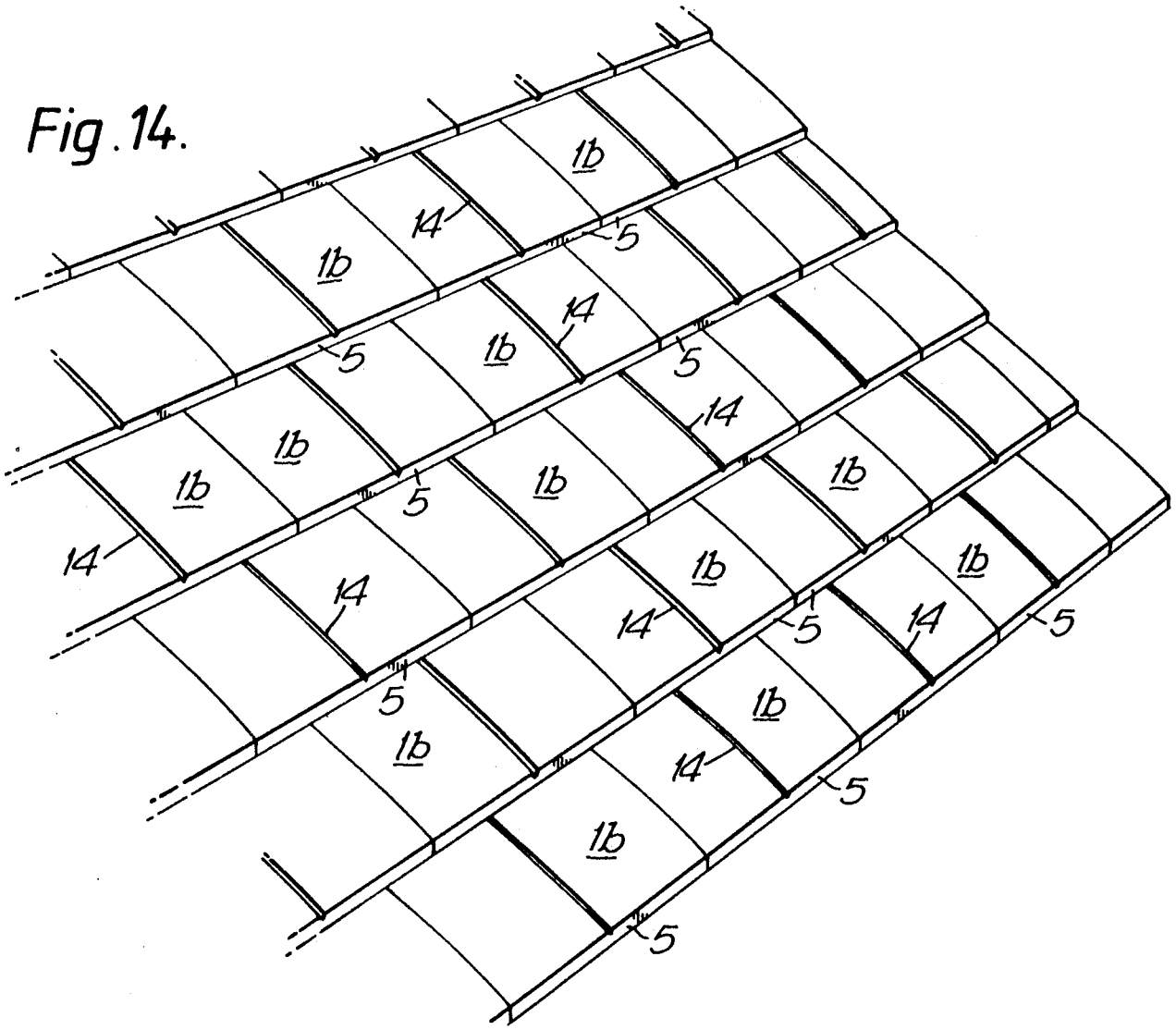

FIG. 7 is an underneath plan view of the concrete slate of FIG. 1 and the plain tile of FIG. 4, FIGS. 8 and 9 are opposite side views respectively of the concrete slate of FIG. 1 and plain tile of FIG. 4, FIGS. 10 and 11 are cross-sections taken along the lines A—A and B—B respectively of FIG. 7, FIG. 12 is a diagrammatic cross-section through a roof structure tiled with the concrete slates of FIG. 1 or plain tiles of FIG. 4, FIG. 13 is diagrammatic perspective view of a tiled roof tiled with the slates of FIG. 1, FIG. 14 is a diagrammatic perspective view of a tiled roof tiled with the plain tiles of FIG. 4, FIGS. 15 and 16 are opposite side views similar to those of FIGS. 8 and 9 of another embodiment, and FIGS. 17 and 18 are cross-sections similar to those of FIGS. 10 and 11 of the embodiment of FIGS. 15 and 16.

The concrete slate 1 shown in FIGS. 1, 2, 3, 7, 8, 9, 10 and 11 is of generally rectangular configuration when considered in plan, and has upper and undersurfaces 2 and 3 respectively, an upper edge 4, a lower (leading) edge 5 and interlocks extending along its opposite side edges in the form of an underlock 6 and an overlock 7, which respectively engage with the over and underlocks of adjacent tiles of the same row. In the lower edge region of the tile the underlock 6 ends short of the lower edge to provide a cut-out 8, which enables the aesthetic appearance of a natural slate and normal plain tile to be maintained because the underlocks do not extend to the lower edge of the tile and are therefore not visible when the tiles are laid on a roof.

As is shown in FIG. 7 the undersurface 3 of the tile is provided with two or more hanging nibs 9 and wind barriers 10. The tile may be provided with nail holes (not shown) adjacent the nibs 9, or, alternatively, as is preferred, securing clips (not shown) may be used instead of nails. Also, the undersurface 3 has hollowed out portions 11, as is known, to reduce weight. The tile 1 is of cambered geometry with the camber extending from the upper edge 4 to lower edge 5 as will be apparent from FIGS. 8 to 11.

Figure 5:
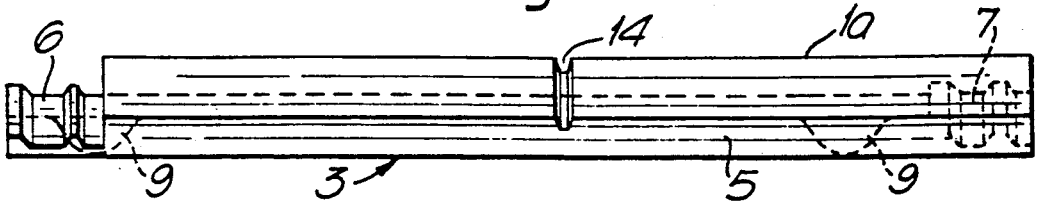
FIGS. 5 and 6 are upper and lower end or edge views respectively of the tile of FIG. 4.
Figure 6:
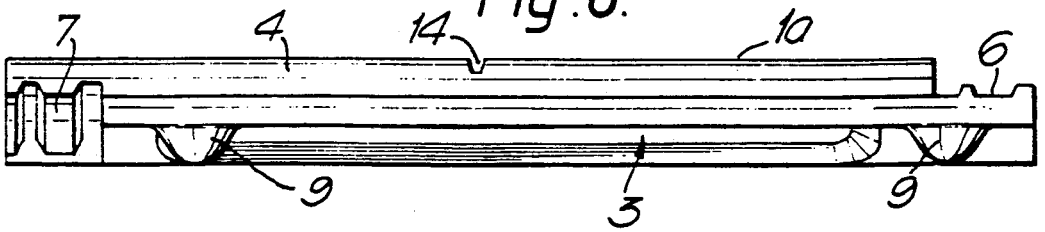

In accordance with the invention, and to enable reduction of the lower edge thickness, and as will be readily apparent from FIGS. 8 to 12, the lower end portion 12 of the tile, at least as far as the lower end of the underlock 6, is tapered in the direction of the leading edge 5, that is, the lower end portion 12 of the tile is thinned, by making the pallets on which the tiles are extruded of an appropriate shape, thereby to produce a lower edge which is aesthetically acceptable. It should be appreciated the tapered area extends transversely across the undersurface of the tile except for the hollowed out positions. Furthermore, the undersurface 13 of the lower portion beyond the underlock 6 extends generally parallel to the upper surface 2 of the tile with there being a step **12*a* between the undersurface 13 and the undersurface of the tapered lower end portion 12. (See FIGS. 8–12) The plain tile 1*a* illustrated in FIGS. 4, 5 and 6 differs from the concrete slate illustrated in FIGS. 1 and 2 only in that it has a longitudinal groove 14 running the full length of the tile 1*a* to form a one piece two tile plain tile 1*a*, each of which is designated by the reference 1*b***.

In FIG. 12, the tiles 1 or **1*a* are mounted on battens 15 fixed to roof rafters such as 16 with the roof felt being shown at 17**.

FIGS. 13 and 14 respectively show how the concrete slates 1 and plain tiles **1*a* (tiles 1*b*) appear as a tiled roof with their narrow, aesthetically acceptable lower edges 5**.

The embodiment of FIGS. 15 to 18 differs from those of FIGS. 1 to 11 in that the tapering lower end portion 12 of the tile merges or extends into the undersurface 13 of the lower edge portion of the tile in the direction of the lower edge 5 without a step **12*a* to form a tapered undersurface 18, which extends transversely across the tile and which is inclined at an angle to the upper surface of the tile. The tapering nature of the surface 18 can be readily appreciated from FIGS. 17 to 18. The tiles of FIGS. 15 to 18 lie in a similar manner to those of FIGS. 1 to 11 as shown in FIGS. 12 to 14. However, an advantage of the embodiments of FIGS. 1 to 11 as compared to that of FIGS. 15 to 18 is that less material is required for the lower edge portion between the leading end of the underlock 6 and the leading edge 5, thereby further reducing the weight of the tile. Whilst particular embodiments have been described, it should be appreciated that the invention is not limited thereto but includes all modifications and variations falling within its scope. For example, in the embodiment of FIG. 4 the groove 14** need not extend the whole length of the tile, e.g. it may be eliminated in the region of the overlap. Moreover, whilst the invention is particularly applicable to extruded roof tiles made of cementitious mixtures, such as concrete, the roof tiles could equally be made of clay which could be pressed, moulded or extruded, and the cementitious material or concrete tiles can also be made by a pressing or moulding operation. Furthermore, it should be understood that the expression "roof" tiles also includes cladding tiles.

We claim:

1. An interlocking roof tile having an upper edge, a lower edge which is visible in use when the tile is laid in overlapping relationship with at least one tile of a next adjacent line of the tiles, an upper surface, a lower surface, two oppositely facing side edges, an underlock extending along one of the side edges and an overlock extending along the other of the side edges, the underlock having a lower end, an undersurface which forms part of the undersurface of the tile, and a lower edge portion which includes a part of the undersurface of the underlock, and which overlaps, in use, at least one tile of the next adjacent line of the tiles, characterized in that the upper surface of the tile extends continuously from the lower edge to the upper edge, in that the upper and lower surfaces are cambered from the lower edge to the upper edge and are substantially flat when considered in cross-section taken along a line extending between the side edges, and in that the lower edge portion including the underlock has a taper which extends in the direction of the lower edge of the tile at least as far as the lower end of the underlock so that, in use, the undersurface of the underlock overlies the continuous upper surface of at least one tile of the next adjacent line of the tiles, whereby the interlocking roof tile can be made by extrusion from a cementitious mixture without needing to perform any subsequent operations on the upper surface of the interlocking tile, the lower end of the interlocking tile is of reduced thickness and thereby is aesthetically acceptable, and can be laid in either a straight relationship or a staggered relationship with respect to the next adjacent line of the tiles.

2. An interlocking roof tile having an upper edge, a lower edge which is visible in use when the tile is laid in overlapping relationship with at least one tile of a next adjacent line of the tiles, an upper surface, a lower surface, two oppositely facing side edges, an underlock extending along one of the side edges and an overlock extending along the other of the side edges, the underlock having a lower end, an undersurface which forms part of the undersurface of the tile, and a lower edge portion which includes a part of the undersurface of the underlock, and which overlaps, in use, at least one tile of the next adjacent line of the tiles, characterized in that the upper surface of the tile extends continuously from the lower edge to the upper edge, in that the upper and lower surfaces are cambered from the lower edge to the upper edge and are substantially flat when considered in cross-section taken along a line extending between the side edges, in that the lower edge portion including the underlock has a taper which extends in the direction of the lower edge of the tile at least as far as the lower end of the underlock so that, in use, the undersurface of the underlock overlies the continuous upper surface of at least one tile of the next adjacent line of the tiles, and in that the tile is made from a cementitious mixture comprising a porous lightweight aggregate capable of retaining water, an hydraulic cement, water, an agent for enhancing flexural strength and an agent for enhancing the water retention capacity of the porous lightweight aggregate during curing of the cementitious mixture, with the porous lightweight aggregate, hydraulic cement, water, flexural strength enhancing agent and water retention enhancing agent being present in proportions which provide the interlocking roof tile with improved impact and flexural strengths, whereby the interlocking roof tile can be made by extrusion from the cementitious mixture without needing to perform any subsequent operations on the upper surface of the interlocking tile, the lower end of the interlocking tile is of reduced thickness and thereby is aesthetically acceptable, can be laid in either a straight relationship or a staggered relationship with respect to the next adjacent line of the tiles, and has a laid weight of approximately 20 to 40 kg/m$^2$ to provide replacement for natural slate roofing which does not require additional expense of strengthening or replacing roof timbers.

3. An interlocking roof tile having an upper edge, a lower edge which is visible in use when the tile is laid in overlapping relationship with at least one tile of a next adjacent line of the tiles, an upper surface, a lower surface, two oppositely facing side edges, an underlock extending along one of the side edges and an overlock extending along the other of the side edges, the underlock having a lower end, an undersurface which forms part of the undersurface of the tile, and a lower edge portion which includes a part of the undersurface of the underlock, and which overlaps, in use, at least one tile of the next adjacent line of the tiles, characterized in that the upper surface of the tile extends continuously from the lower edge to the upper edge, in that the upper and lower surfaces are cambered from the lower edge to the upper edge and are substantially flat when considered in cross-section taken along a line extending between the side edges, in that the undersurface of the lower edge portion of the tile beyond the lower end of the underlock is disposed generally parallel to that part of the continuous upper surface of the tile which is opposed to the undersurface of the lower edge portion, and in that the lower edge portion including the underlock has a taper which extends in the direction of the lower edge of the tile at least as far as the lower end of the underlock so that, in use, the undersurface of the underlock overlies the continuous upper surface of at least one tile of the next adjacent line of the tiles, whereby the interlocking roof tile can be made by extrusion from a cemetitious mixture without needing to perform any subsequent operations on the upper surface of the interlocking tile, the lower end of the interlocking tile is of reduced thickness and thereby is aesthetically acceptable, and can be laid in either a straight relationship or a staggered relationship with respect to the next adjacent line of the tiles.

4. A roof tile as claimed in claim 3, wherein there is a step between the lower end of the underlock and the generally parallel undersurface of the lower edge portion of the tile beyond the underlock.

* * * * *